US005331932A

United States Patent [19]

Watanabe et al.

[11] Patent Number: 5,331,932

[45] Date of Patent: Jul. 26, 1994

[54] ENGINE PISTON

[75] Inventors: Hiroaki Watanabe; Masaharu Kitamura, both of Atsugi, Japan

[73] Assignee: Unisia Jecs Corporation, Atsugi, Japan

[21] Appl. No.: 96,614

[22] Filed: Jul. 23, 1993

[30] Foreign Application Priority Data

Aug. 11, 1992 [JP] Japan ..... 4-56479[U]

[51] Int. Cl.[5] ..... F02F 3/02

[52] U.S. Cl. ..... 123/193.6; 92/239

[58] Field of Search ..... 123/193.6; 92/237, 238, 92/239

[56] References Cited

U.S. PATENT DOCUMENTS

| | | | |
|---|---|---|---|
| 4,715,267 | 12/1987 | Richmond | 92/239 |
| 4,756,241 | 7/1988 | Sakurahara et al. | 123/193.6 |
| 4,785,774 | 11/1988 | Tokoro et al. | 92/239 |
| 5,063,893 | 11/1991 | Iwaya | 123/193.6 |
| 5,076,225 | 12/1991 | Tokoro et al. | 123/193.6 |
| 5,245,913 | 9/1993 | Kato | 123/193.6 |

FOREIGN PATENT DOCUMENTS 62-85152 4/1987 Japan .

*Primary Examiner*—Tony M. Argenbright
*Assistant Examiner*—M. Macy
*Attorney, Agent, or Firm*—Bachman & LaPointe

[57] ABSTRACT

A piston skirt has narrowed relief sections adjacent piston bosses and between first and second relief sections. The first relief sections extend between a piston head and respective piston bosses whist the second relief sections extend downward from the respective piston bosses. The narrowed relief sections are spaced from each other in parallel to piston pin holes at a distance which is smaller than that at which the first and second relief sections are space from each other, respectively. The narrowed relief sections are formed thicker and therefore more rigid than the first and second relief sections so that the piston skirt is more rigid adjacent the piston bosses and less rigid above and below the piston bosses, whereby to effectively lessen side thrust of the piston to the cylinder wall without deteriorating the durability.

12 Claims, 3 Drawing Sheets

ENGINE PISTON

BACKGROUND OF THE INVENTION

1. Field of the Invention

The present invention relates to pistons for internal combustion engines, particularly for automotive internal combustion engines.

2. Description of the Prior Art

Heretofore, lightweight and quiet operation have been required of automotive internal combustion engines. To meet this requirement, various improvements have been made particularly to a piston which is to transmit force of explosion to a crankshaft by way of a piston pin and a connecting rod. For example, a piston disclosed by Japanese Patent Provisional Publication No. 62-85152 is devised to have a skirt which is tapered toward an upper end and reduced in a bearing area with a view to improving both the durability and the lightweight characteristic.

However, the above described prior art piston is constructed so as to transmit side thrust to the cylinder wall by way of the skirt, so in case the piston skirt, particularly the lower section thereof posses a high rigidity vibrations of the piston are liable to be caused by the side thrust to result in a knocking noise known as "piston slap".

SUMMARY OF THE INVENTION

According to an aspect of the present invention, there is provided a piston for an internal combustion engine which comprises a piston skirt and piston bosses formed with piston pin holes. The piston skirt is so shaped as to define therewithin a cavity having such a width parallel to the piston pin holes that vertically varies in such a manner as to become smaller adjacent the piston bosses and larger above and below the piston bosses.

According to an another aspect of the present invention, there is provided a novel and improved piston for an internal combustion engine, which comprises a piston head, a piston skirt and piston bosses formed with piston pin holes. The piston skirt has one thrust sides thereof bearing portions for contact with an associated cylinder wall of the engine and on piston boss sides thereof relief portions which are located radially more inward than said bearing portions. The relief portions have vertically separated first and second relief sections. The first relief sections extend between the piston head and the piston bosses whilst the second relief sections extend downward from the piston bosses. The relief portions further have narrowed relief sections adjacent the piston bosses and between the first and second relief sections.

Those structures effective for solving the above noted problem inherent in the prior art piston.

It is accordingly an object of the present invention to provide a novel and improved piston for an internal combustion engine which is assuredly prevented from causing a knocking noise known as "piston slap".

It is another object of the present invention to provide a novel and improved piston of the above described character which is provided with means for effectively absorbing side thrust without lowering the strength or deteriorating the durability.

It is a further object of the present invention to provide a novel and improved piston of the above described character which is particularly suited for use in an automotive internal combustion engine.

DETAILED DESCRIPTION OF THE PREFERRED EMBODIMENTS

Figure 1:
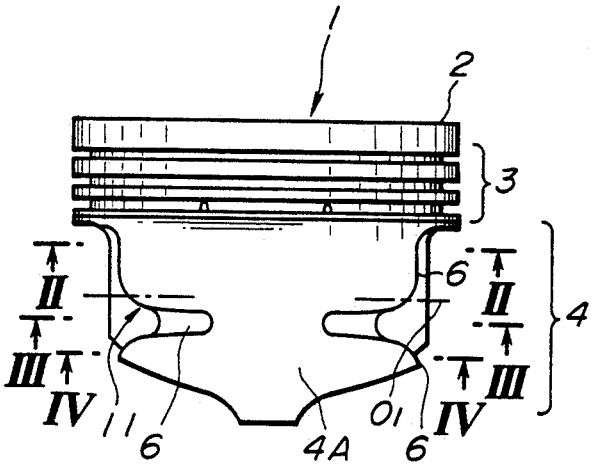
FIG. 1 is a side elevational view of a piston according to an embodiment of the present invention.

Referring first to FIGS. 1 to 4, a piston according to an embodiment of the present invention is generally indicated by 1. The piston 1 has a head or crown 2, lands 3 and a skirt 4. In this embodiment, the piston skirt 4 has on thrust sides thereof bearing portions 4*a* for contact with a cylinder wall 10 (refer to FIG. 6) and on piston pin sides thereof, i.e., on the sides where the piston 1 is not subjected to side thrust, skirt portions 6 which are located radially more inward than the bearing portions 4*a*. The above described skirt portions 6 located on the piston pin sides and radially more inward than the bearing portions 4A are hereinafter referred to as relief portions.

Figure 2:
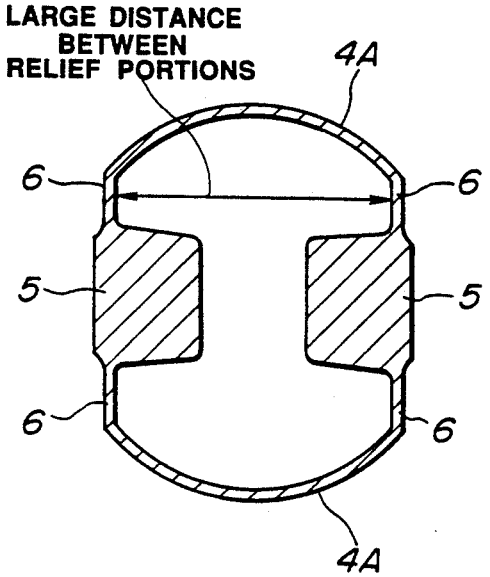
FIGS. 2 to 4 are sectional views taken along the lines II—II, III—III and IV—IV of FIG. 1, respectively.
Figure 3:
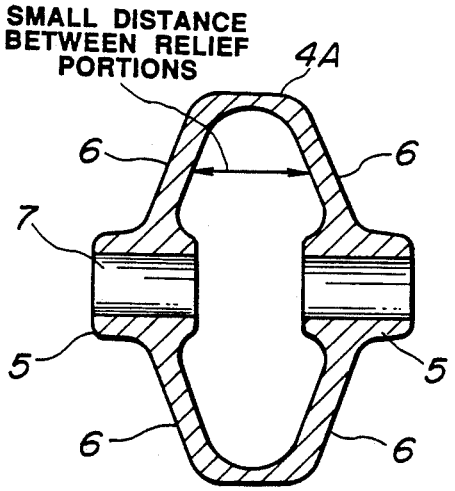
Figure 4:
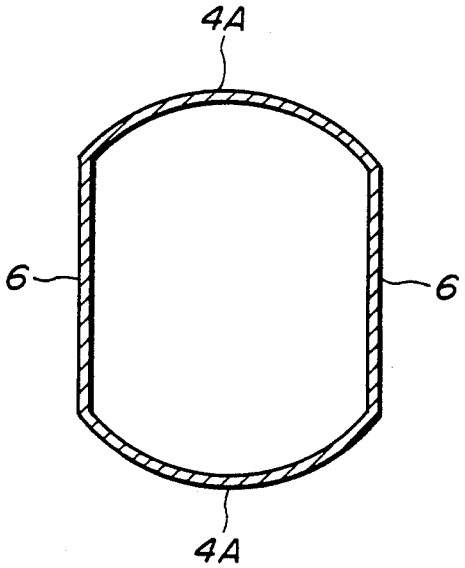

The piston skirt 4 with such relief portions 6 has at an upper section indicated by II—II in FIG. 1 such a sectional shape shown in FIG. 2 and at a lower section indicated by IV—IV of FIG. 1 such a sectional shape shown in FIG. 4. Further, the piston skirt 4 has at an intermediate section between the above described upper and lower sections and indicated by III—III in FIG. 1 such a sectional shape shown in FIG. 3. The piston skirt 4 thus has at the upper section indicated by II—II in FIG. 1 a sufficiently large distance between the relief portions 6 which are opposed in parallel with piston pin holes 7 and therefore a low rigidity. At the intermediate section indicated by III—III in FIG. 1 or adjacent thereto, the piston skirt 4 is withdrawn radially inward to have the narrowed relief portion 11, thus reducing the bearing portions 4*a* and attaining a high rigidity. The axis or center line of the piston pin holes 7 is indicated by "$0_1$" in FIG. 1 and FIG. 5. The intermediate section indicated by III—III in FIG. 1 is located below the axis "$0_1$" of the piston pin holes 7. At the section indicated by IV—IV in FIG. 1, the piston skirt 4 has a large distance between the relief portions 6, thus attaining a low rigidity. In other words, the piston skirt 4 is so shaped as to define therewithin a cavity 4B of such a width parallel to the piston pin bosses 7 that vertically varies in such a manner as to become smaller adjacent the piston bosses 5 (i.e., at the section indicated by III—III in FIG. 1) and larger above and below the piston bosses 5 (i.e., at the sections indicated by II—II and IV—IV in FIG. 1, respectively).

Figure 5:
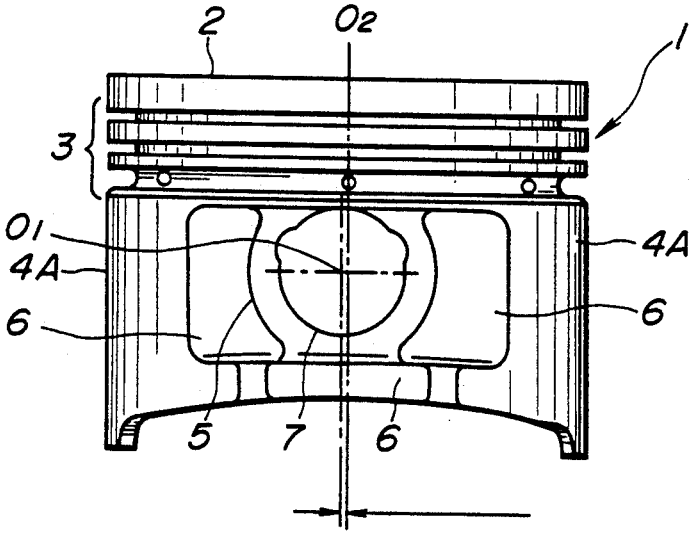
FIG. 5 is a side elevational view of the piston of FIG. 1 when the piston is observed from a different direction, i.e., from a direction of a piston pin hole.

FIG. 5 is a view taken in the axial direction of the piston pin holes 7. As seen from FIG. 5, the piston pin holes 7 are arranged so as to offset a little from an axis or center line "$0_2$" of the piston 1 toward the thrust side so as to constitute an offset piston with a view to attaining a further improved ability of preventing "piston flutter" and "piston slap".

Figure 6:
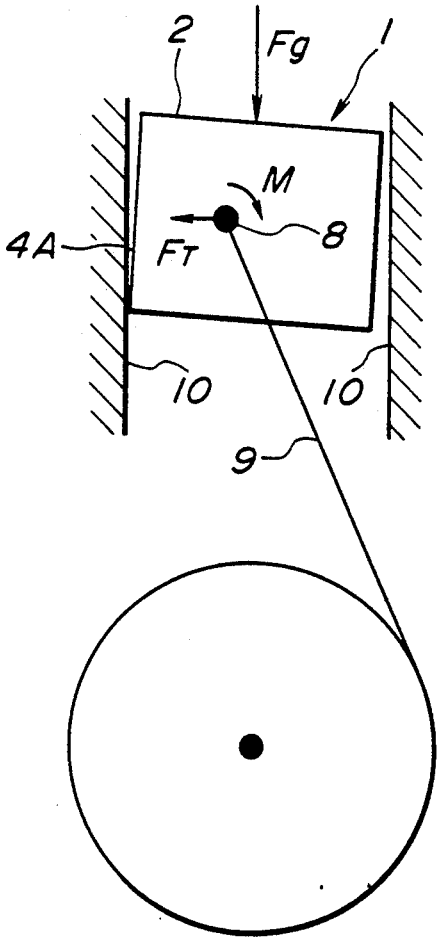
FIG. 6 is a schematic view for illustration of the forces created in the piston of FIG. 1 during its operation.

The operation of the piston 1 will be described hereinbelow with additional reference to FIG. 6.

When a pressure $F_g$ of explosion is applied to the head 2 of the piston 1, the piston 1 is subjected to a moment M about a piston pin 8 whilst being subjected to a side thrust $F_T$ applied thereto by way of a connecting rod 9 and the piston pin 8, whereby the piston 1 is brought into contact at a lower section of one of the bearing portions 4A of the piston skirt 4 with the cylinder wall 10. However, the lower section of the piston skirt 4 has a low rigidity since it has such a sectional shape shown in FIG. 4 in which the bearing portions 4A of the piston skirt 4 are supported by the relief portions 6 with a low rigidity, so that the lower section of the piston skirt 4 is deformed to absorb the side thrust $F_T$ for thereby preventing the piston 1 from making a knocking noise known as "piston slap".

As the piston 1 goes downward, the side thrust $F_T$ increases. In this instance, the side thrust $F_T$ is mainly sustained by the intermediate section of the piston 4 having such a sectional shape shown in FIG. 3 in which the distance between the relief portions 6 is small to effect a high rigidity. Thereafter, when the side thrust $F_T$ increases further and becomes maximum, the center of the side thrust $F_T$ is urged to move into the upper section of the piston skirt 4 having such a sectional shape shown in FIG. 2. However, since this upper section has a low rigidity, it is not rigid enough to sustain the side thrust $F_T$ but allow it to be sustained by the narrowed relief portions 6 having such a sectional shape shown in FIG. 3. In the above manner, the side thrust $F_T$ is absorbed by the upper and lower sections of the piston skirt 4 while retaining a sufficient rigidity at the intermediate section near the piston bosses 5, thus making it possible to effectively absorb side thrust for thereby preventing "piston slap" which is liable to be produced at the top dead center and bottom dead center of the piston 1.

In the foregoing, it is to be noted that the section of the piston skirt 4 having such a sectional shape shown in FIG. 2, is formed so as to have a relatively smaller thickness at the bearing portions 4A and a relatively large thickness at the narrowed relief portions 6 extending from the bearing portions 4A to the boss portions 5, whereby it becomes possible to attain effective allotment and absorption of side thrust which contribute to prevention of "piston slap".

It is further to be noted that the section of the piston skirt 4 having such a sectional shape shown in FIG. 2 or 4, is formed so as to have a smaller thickness at the bearing portions 4A and the relief portions 6, whereby it becomes possible to make more pronounced the above described effect of preventing "piston slap".

Figure 7:
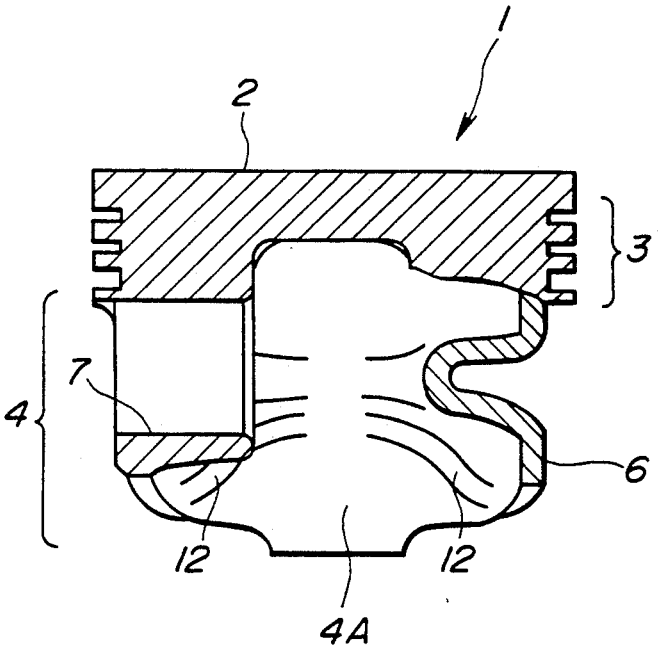
FIG. 7 is a partly sectioned, side elevational view of a piston according to a further embodiment of the present invention.

FIG. 7 shows another embodiment in which ribs 12 are formed in such a manner as to elongate obliquely from the relief portions 6 toward the bearing portions 4A such that by these ribs 12 it becomes possible, at the time of maximum side thrust, to allot the thrust partially to the narrowed relief portions 6, which thrust is otherwise sustained solely by the lower section having such a sectional shape shown in FIG. 4. The ribs 12 are elongated so as not to reach to the circumferential center of the bearing portions 4A so that the section having such a sectional portion shown in FIG. 4 can retain a low rigidity.

WHAT IS CLAIMED IS:

1. A piston for an internal combustion engine, comprising a piston skirt and piston bosses formed with piston pin holes, wherein said piston skirt is so shaped as to define therewithin a cavity having a width parallel to said piston pin holes that vertically varies in such a manner as to become smaller adjacent said piston bosses and larger above and below said piston bosses.

2. A piston according to claim 1, wherein said piston skirt has on thrust sides thereof bearing portions for contact with an associated cylinder wall of the engine and on piston boss sides thereof relief portions which are located radially more inward than said bearing portions, said relief portions having narrowed sections for effecting said smaller width of said cavity, said narrow sections being located lower than an axis of said piston pin holes.

3. A piston according to claim 2, wherein said piston skirt gradually increases in thickness from said bearing portions toward said narrowed sections of said relief portions.

4. A piston according to claim 3, wherein at least one of said bearing portions above and below said piston bosses is thinner than parts of said relief portions adjacent said piston bosses.

5. A piston according to claim 4, further comprising ribs provided inside of said piston skirt in such a manner as to extend from said narrowed sections of said relief portions to areas of said bearing portions adjacent said piston bosses.

6. A piston for an internal combustion engine, comprising a piston head, a piston skirt and piston bosses formed with piston pin holes, wherein said piston skirt has on thrust sides thereof bearing portions for contact with an associated cylinder wall of the engine and on piston boss sides thereof relief portions which are located radially more inward than said bearing portions, said relief portions having vertically separated first and second relief sections, said first relief sections extend between said piston head and said piston bosses whilst said second relief sections extend downward from said piston bosses, said relief portions further having narrowed relief sections adjacent said piston bosses and between said first and second relief sections.

7. A piston according to claim 6, wherein said narrowed relief sections are spaced from each other in the direction parallel to said piston pin holes and at a distance which is smaller than that at which said first and second relief sections are separated from each other, in the direction parallel to said piston pin holes, respectively

8. A piston according to claim 7, wherein said bearing portions are partly vertically separated by said narrowed relief sections.

9. A piston according to claim 6, wherein said narrowed relief sections are located lower than an axis of said piston pin holes.

10. A piston according to claim 7, wherein said bearing portions of said piston skirt gradually increase in thickness toward said narrowed relief sections.

11. A piston according to claim 6, wherein at least one of said bearing portions is thinner than parts of said relief portions adjacent said piston bosses.

12. A piston according to claim 7, further comprising ribs provided inside of said piston skirt in such a manner as to extend from said narrowed relief sections to areas of said bearing portions adjacent said piston bosses.

* * * * *